US008661703B1

(12) United States Patent
Bensalma

(10) Patent No.: US 8,661,703 B1
(45) Date of Patent: Mar. 4, 2014

(54) MACHINE FOR DRYING FIELD CROPS

(71) Applicant: Salah Jomaan Hamdan Bensalma, Salwa (KW)

(72) Inventor: Salah Jomaan Hamdan Bensalma, Salwa (KW)

( * ) Notice: Subject to any disclaimer, the term of this patent is extended or adjusted under 35 U.S.C. 154(b) by 0 days.

(21) Appl. No.: 13/736,896

(22) Filed: Jan. 8, 2013

(51) Int. Cl.
*F26B 19/00* (2006.01)

(52) U.S. Cl.
USPC ..... 34/88; 34/217

(58) Field of Classification Search
USPC ..... 34/88, 203, 207, 217; 198/603, 626.1, 198/626.2, 690.2
See application file for complete search history.

(56) References Cited

U.S. PATENT DOCUMENTS

| | | | | | |
|---|---|---|---|---|---|
| 2,326,889 | A | * | 8/1943 | Schulz et al. | 425/372 |
| 2,350,096 | A | * | 5/1944 | Chilton | 426/314 |
| 2,419,876 | A | * | 4/1947 | Clarence | 34/586 |
| 2,452,983 | A | * | 11/1948 | Clarence | 426/464 |
| 2,575,426 | A | * | 11/1951 | Parnell | 426/241 |
| 2,806,337 | A | | 9/1957 | Rezabek | |
| 3,102,795 | A | * | 9/1963 | Andrew et al. | 34/500 |
| 3,512,765 | A | | 5/1970 | Van der Lely | |
| 3,545,734 | A | | 12/1970 | Van der lely | |
| 3,572,663 | A | | 3/1971 | Van der Lely | |
| 3,762,558 | A | * | 10/1973 | Anderson | 210/242.3 |
| 3,793,745 | A | * | 2/1974 | Myers | 34/189 |
| 4,196,527 | A | * | 4/1980 | Escande | 34/203 |
| 4,316,536 | A | * | 2/1982 | Verbeek | 198/699 |
| 4,399,619 | A | * | 8/1983 | Martin | 34/611 |
| 4,419,834 | A | * | 12/1983 | Scott | 34/580 |
| 4,831,746 | A | * | 5/1989 | Kim et al. | 34/421 |
| 5,060,459 | A | | 10/1991 | Herron | |
| 5,105,563 | A | * | 4/1992 | Fingerson et al. | 34/203 |
| 5,557,859 | A | | 9/1996 | Baron | |
| 5,840,187 | A | * | 11/1998 | Derenthal et al. | 210/400 |
| 6,133,549 | A | * | 10/2000 | Shih et al. | 219/388 |
| 7,073,274 | B2 | * | 7/2006 | Yoshida | 34/619 |

* cited by examiner

*Primary Examiner* — Kenneth Rinehart
*Assistant Examiner* — Jason Lau
(74) *Attorney, Agent, or Firm* — Richard C. Litman

(57) ABSTRACT

The machine for drying field crops includes lower and upper conveyors, the space between the two serving as a drying chamber. The upper conveyor is powered and drives the lower conveyor through a plurality of lateral flights that engage one another to keep the two conveyors in registry. A heating system is provided beneath the lower conveyor. Heat is delivered to a plenum between the two runs of the lower conveyor. The two conveyors are porous to allow heated air and light to pass therethrough. Heated air from the lower plenum passes through the lower belt and the drying chamber between the two conveyors, and into a collector plenum between the two runs of the upper conveyor, where it is exhausted to the atmosphere. Infrared or other lighting may also be provided in the two plenums. Alternatively, the machine embodiments may have multiple laterally situated conveyor runs.

18 Claims, 5 Drawing Sheets

MACHINE FOR DRYING FIELD CROPS

BACKGROUND OF THE INVENTION

1. Field of the Invention

The present invention relates generally to agricultural operations, and particularly to a machine for drying field crops.

2. Description of the Related Art

Field crops of various kinds are commonly dried for convenience in handling and transport, particularly in the case of animal fodder. Such crops are quite heavy when they still contain their normal moisture content from their live state. As a result, it is common to cut such crops, but to leave them in the field for natural drying, and then to gather the dried crops later.

While this process is generally relatively economical, it may be a false economy, depending upon the environment where the crops are left to dry. In many cases, the residual moisture in the crops provides a suitable environment for various molds and fungi that can ruin the crop and make it unsuitable for either human or animal consumption. In other cases, rain or snow may impede the drying process to a considerable degree. Moreover, mice and/or other vermin may use the drying field crop for food and/or nesting. It would clearly be better to use some artificial drying process in such circumstances to hasten the drying and gathering process, rather than to leave the crop in the field.

Thus, a machine for drying field crops solving the aforementioned problems is desired.

SUMMARY OF THE INVENTION

The machine for drying field crops generally includes one or more conveyor pairs that define a heated drying chamber therebetween. A passive or non-driven lower conveyor carries the crop into the chamber, and is driven by a drive conveyor above the non-driven conveyor. The overhead drive conveyor includes a plurality of lateral flights that engage corresponding flights on the driven conveyor to maintain their registry with one another.

The two conveyors are porous to allow both light and heated air to pass therethrough. A heating system is placed below the lower or return run of the lower conveyor. Heated air is ducted to a plenum between the two runs of the lower conveyor. The heated air passes from the plenum and through the upper run of the lower belt, to heat the drying chamber defined between the two conveyors. The heated air then passes upward through the lower run of the upper conveyor and into a receiver plenum, where it is exhausted to the atmosphere. The two plenums may also include a plurality of infrared or other lights to add to the drying process.

A number of embodiments are disclosed herein. For larger fields, the apparatus may comprise a trailer or self-propelled vehicle that gathers the previously cut crops and passes them through the drying system. Alternatively, the apparatus may be stationary, with crops being transported to the apparatus for drying. Smaller operations may require an apparatus having only a single lower conveyor and a single upper conveyor. Alternatively, larger systems may be constructed to have two or more laterally placed lower conveyors and corresponding upper conveyors.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The machine for drying field crops is a portable device that captures freshly cut crops in a vertically narrow crop drying enclosure between two porous conveyor belts, and dries the crops by application of heat flowing through the porous belts. The machine may be placed in a fixed location or may be provided with wheels (driven or undriven) for mobility.

Figure 1:
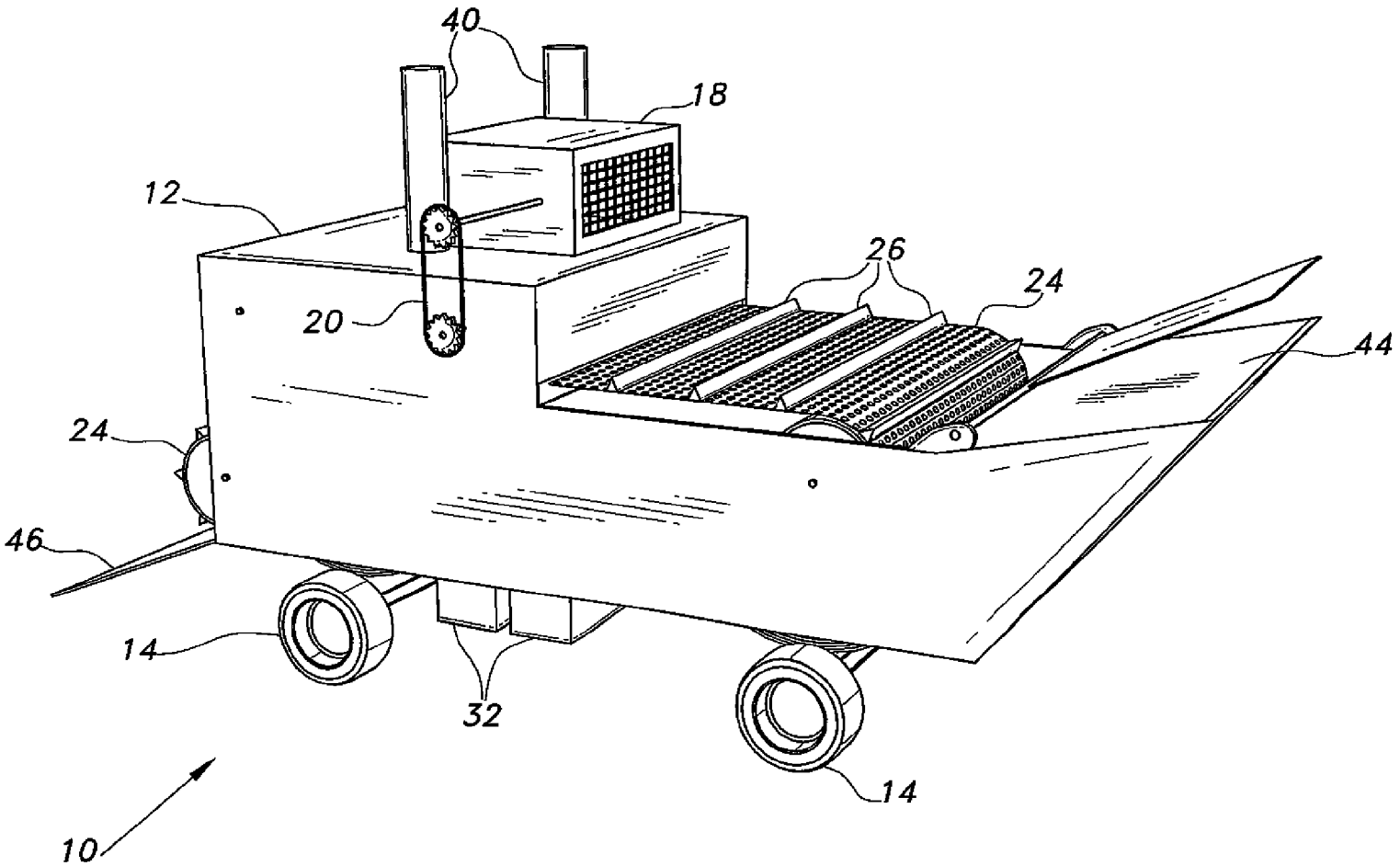
FIG. 1 is a perspective view of a first embodiment of a machine for drying field crops according to the present invention, illustrating its general configuration and features.

FIG. 1 of the drawings provides a perspective view of a first embodiment of the machine for drying field crops 10. The machine 10 includes a chassis 12, which may optionally be placed upon wheels 14, as shown. Alternatively, the wheels 14 may be deleted, and the machine may be semi-permanently installed in a fixed location. The wheels 14 may be driven to provide the machine with self-propulsion, or may be non-driven, requiring connection to another vehicle for movement.

Figure 2:
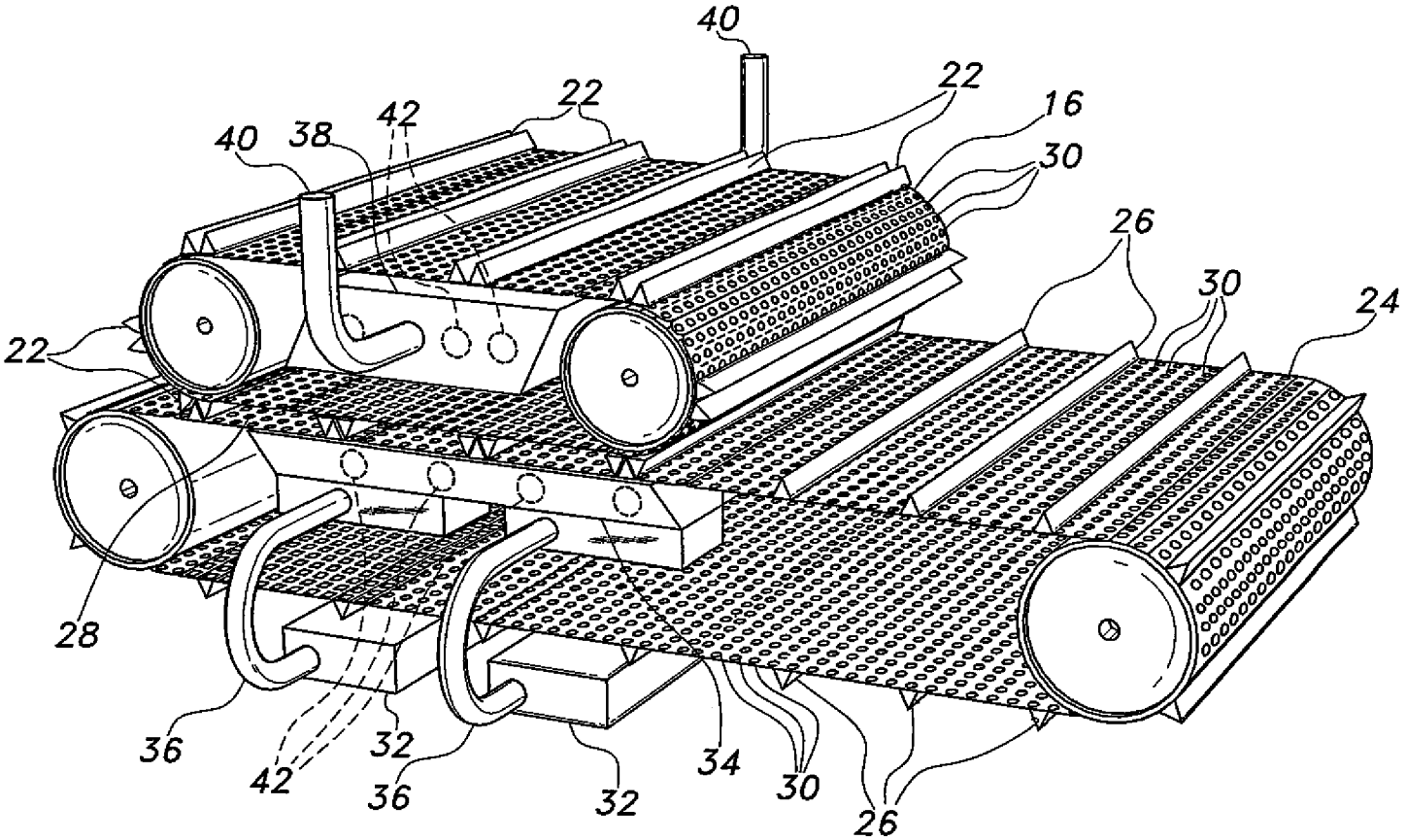
FIG. 2 is a perspective view of the conveyor and heating apparatus of the machine for drying field crops of FIG. 1, illustrating further details thereof.

The chassis 12 contains two cooperating, generally horizontally disposed endless conveyor belts, as shown in FIG. 2 of the drawings. An upper conveyor 16 is driven by a prime mover 18 (shown atop the chassis 12 in FIG. 1) through an appropriate drive system 20 (e.g., the chain and sprocket drive shown in FIG. 1). The prime mover may be selected from any of a number of conventional systems, e.g., internal combustion engine, electric motor, etc., as desired. The upper conveyor 16 includes a plurality of flight pairs 22 extending laterally thereacross. Each upper conveyor flight pair 22 comprises two immediately adjacent flights, which each comprise a raised ridge extending transversely across the conveyor belt 16. These upper conveyor flight pairs 22 serve to drive the lower conveyor 24, a portion of which is also shown in FIG. 1. The lower conveyor 24 includes a plurality of single flights 26 extending laterally thereacross, which are spaced along the conveyor run in a manner corresponding to the spacing of the flight pairs 22 of the upper conveyor 16. The two conveyors 16 and 24 are meshed together by each of the flight pairs 22 of the upper conveyor 16 capturing a corresponding one of the single flights 26 therebetween as the lower run of the upper conveyor 16 passes close to the upper run of the lower conveyor 24, generally as shown in FIG. 2 of the drawings. The heights of the conveyor flights 22 and 26 preclude direct contact between the two belts in their runs, and define a relatively low, i.e., a vertically narrow crop drying enclosure 28 therebetween. The belt of each conveyor 16 and 24 is porous to heat and light because of a large number of porosities 30 formed through each belt.

Figure 3:
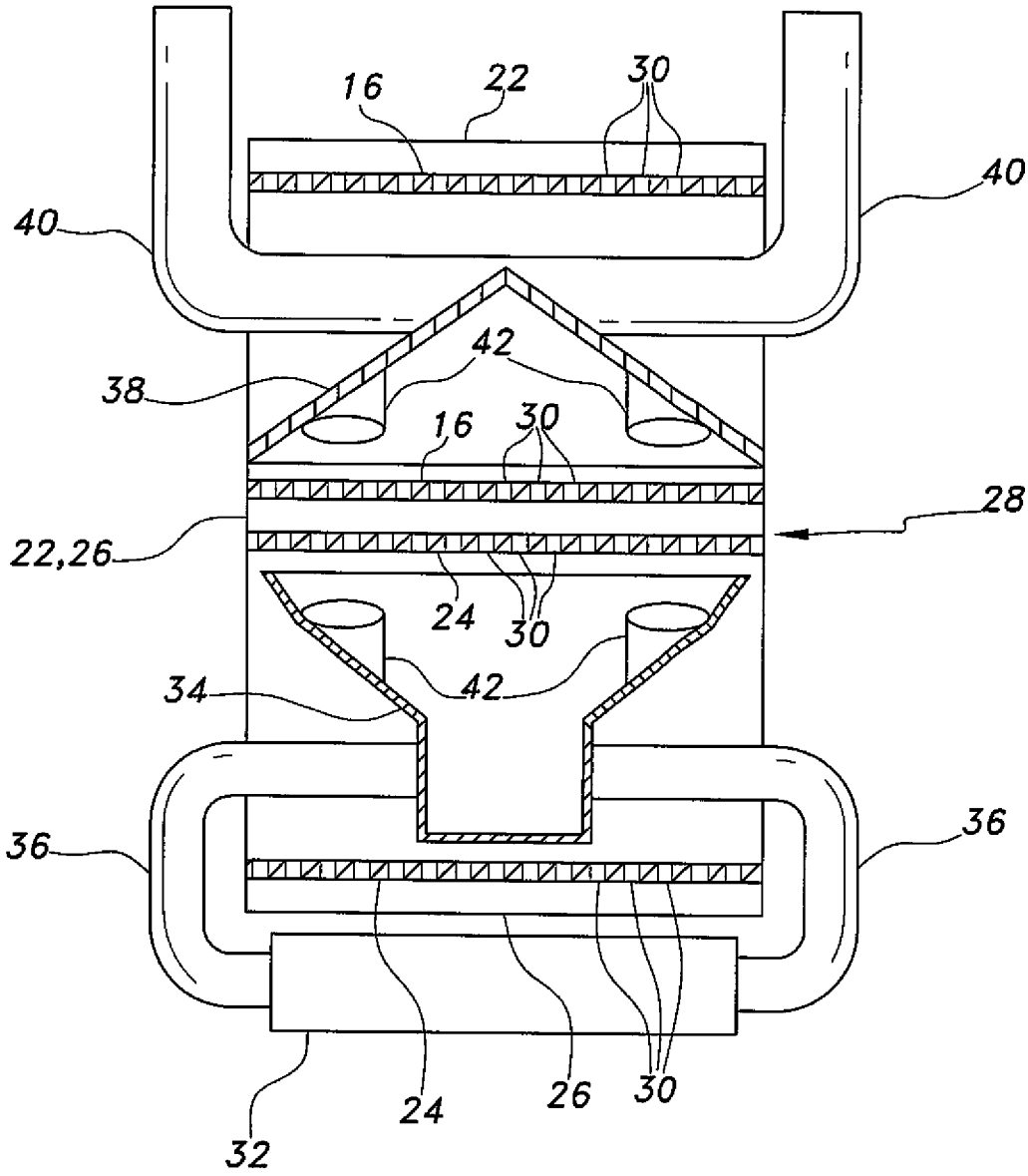
FIG. 3 is an elevation view in section across the conveyor and heating apparatus of FIG. 2, illustrating further details thereof.

An air heating system is installed beneath the lower run of the lower conveyor 24, as shown in FIGS. 1, 2, and 3 of the drawings. The air heating system comprises at least one, and preferably two heaters or heating chambers 32, which produce heated air conventionally by the combustion of fuel or electrical resistance heating. The heaters 32 are connected to a lower plenum 34, which is disposed between the upper and lower runs of the lower conveyor 24, by a plurality of lower ducts 36. The lower plenum 34 receives the heated air from the heaters 32. The heated air rises from the open top of the lower plenum 34 through the pores 30 in the belt of the lower conveyor 24 and into the crop drying enclosure 28 between the two conveyors 16 and 24. The heated air passing through the crop drying enclosure 28 evaporates moisture from the field crops captured therein. The moist and heated air rises through the pores of the lower run of the belt of the upper conveyor 16 into an upper plenum 38. The warm, moist air is then exhausted from the machine 10 by outlet ducts 40 extending from the upper plenum 38.

Additional heating and drying may be provided in addition to, or in lieu of, the heated air of the heater system 32. As an example, either or both of the plenums 34 and/or 38 may contain infrared or other lighting devices 42 therein. (These lighting devices are indicated in broken lines in FIG. 2, as they are contained inside the two plenums 34 and 38.) The lighting devices 42 are focused toward the belts of the respective conveyors 16 and 24, i.e., toward the crop drying enclosure 28 therebetween. Light and heat generated by the lighting devices 42 passes through the belt pores 30 to dry the field crops captured in the crop drying enclosure 28.

Moist field crops are fed into the machine 10 through an inlet 44 at the front of the machine, as shown in FIG. 1 of the drawings. The inlet 44 channels the moist field crops onto the upper run of the extended forward portion of the longer lower conveyor 24, where the belt and its flights 26 carry the moist field crops into the crop drying enclosure 28 between the two conveyors 16 and 24. The field crops are heated in the crop drying enclosure 28 to expel the moisture therefrom, as described further above, and the warm and moist air is expelled from the machine 10, also as described above. The dried crops pass to a discharge ramp 46 extending from the machine 10, where the dried crops may be gathered by a following vehicle (in the case of a mobile machine 10) or gathered into a crib or other container (in the case of an immobile machine).

Figure 4:
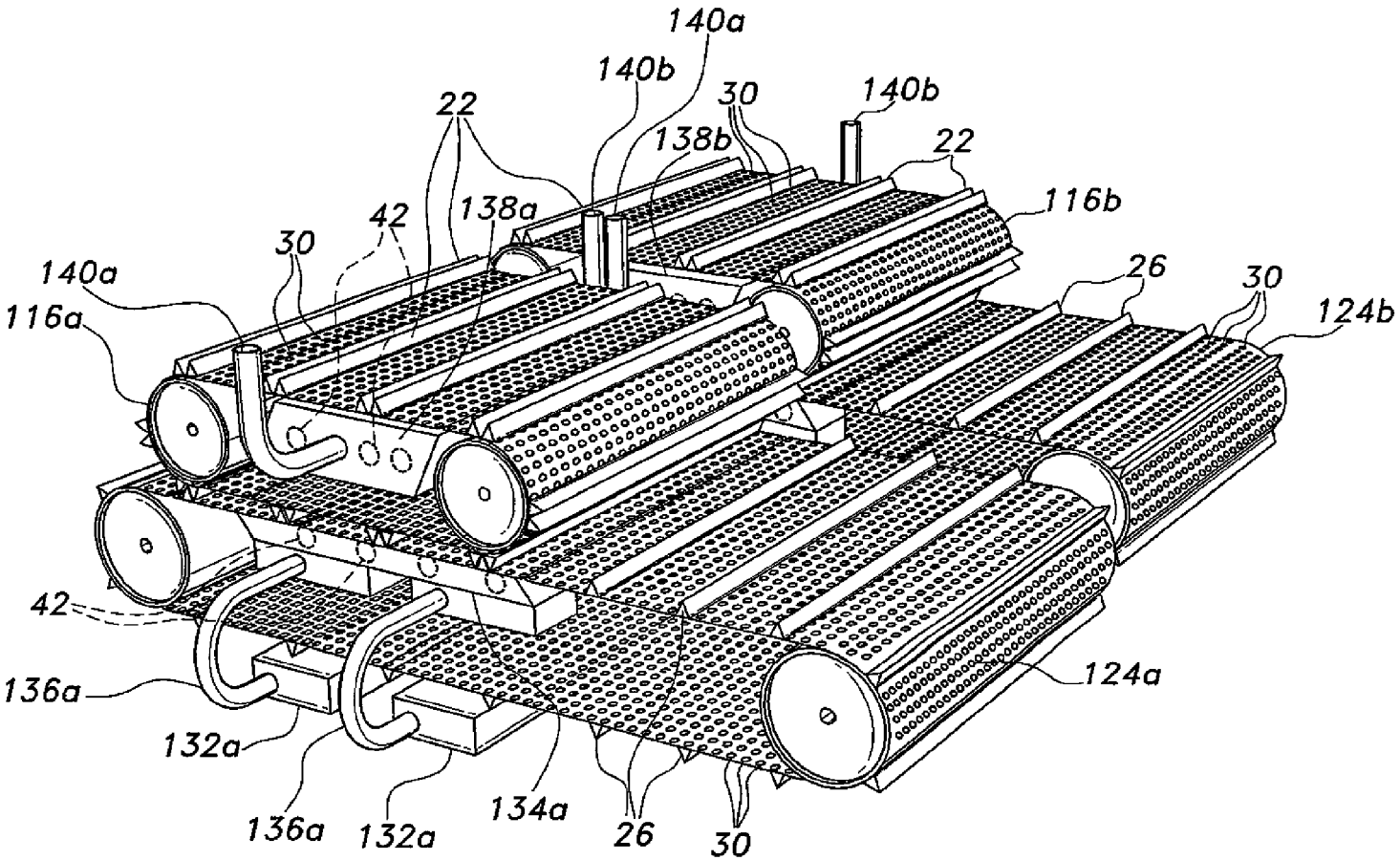
FIG. 4 is a perspective view of a conveyor and heating apparatus of an alternative embodiment of a machine for drying field crops according to the present invention, wherein a dual conveyor system is provided.
Figure 5:
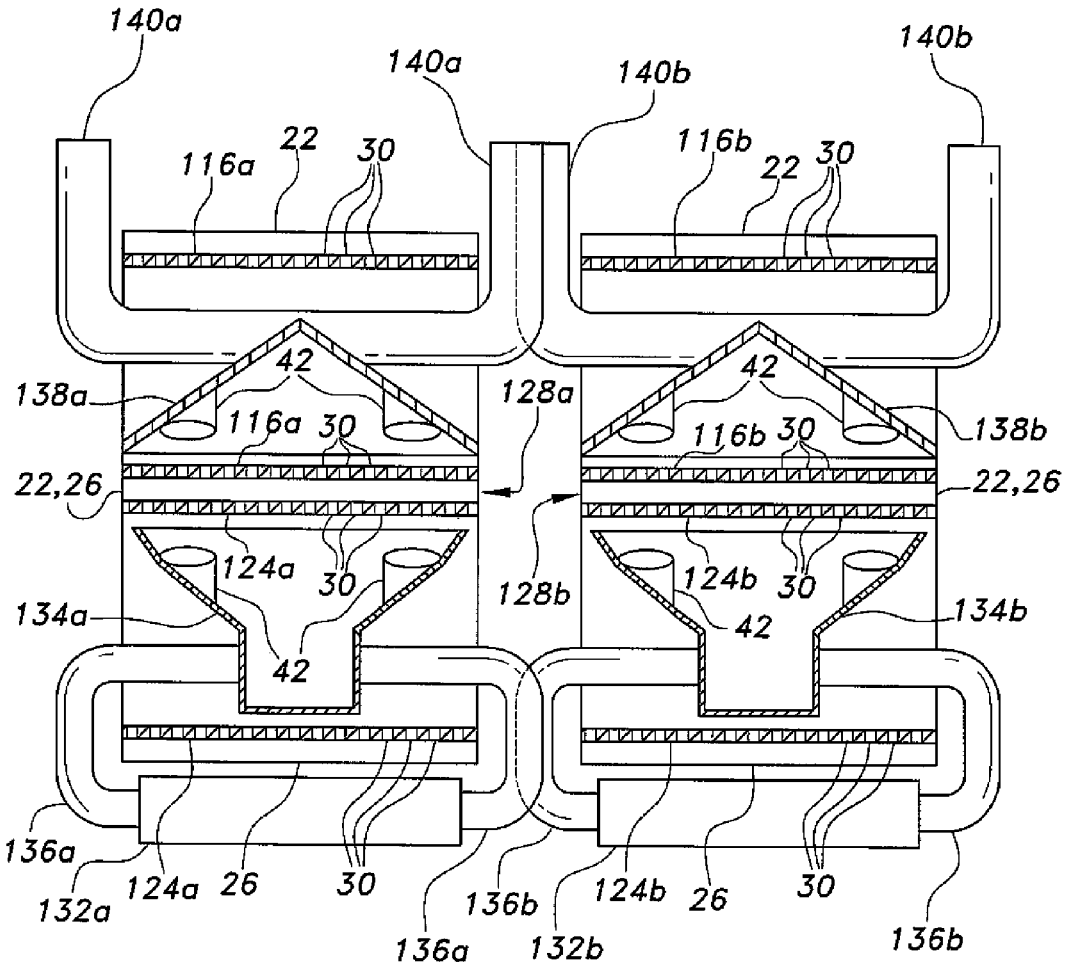
FIG. 5 is an elevation view in section across the conveyor and heating apparatus of FIG. 4, illustrating further details thereof.

FIGS. 4 and 5 illustrate the internal mechanism of an alternative embodiment, wherein two upper and lower conveyor assemblies, heater systems, and plenums are disposed laterally from one another, side-by-side. The system of FIGS. 4 and 5 will be seen to be capable of substantially doubling the crop-drying capacity of the machine 10 of FIGS. 1 through 3. The system of FIGS. 4 and 5 comprises laterally disposed first and second upper conveyors 116*a* and 116*b* having laterally disposed first and second lower conveyors 124*a* and 124*b* engaged therewith, as in the single upper and lower conveyor embodiment of FIGS. 1 through 3. Each of the conveyors 116*a* and 116*b* is substantially identical to the single upper conveyor 16 of the embodiment of FIGS. 1 through 3, i.e., having a large number of pores 30 formed therethrough and a plurality of flight pairs 22 extending thereacross. Each of the lower conveyors 124*a* and 124*b* is also substantially identical to the single lower belt 24 of FIGS. 1 through 3, having a large number of pores 30 and a plurality of single flights 26 extending thereacross. The upper conveyors 116*a* and 116*b* may be driven by a single drive source, and drive the corresponding lower conveyors 124*a* and 124*b* in the manner described further above for the single upper and lower conveyor belt embodiment of FIGS. 1 through 3. Each pair of upper and lower belts defines a crop drying enclosure therebetween. Both crop drying enclosures 128*a* and 128*b* are shown in the section view of FIG. 5.

One or more heaters are installed beneath each of the lower conveyors 124*a* and 124*b*, such as heaters 132*a* beneath the first lower conveyor 124*a* and heaters 132*b* beneath the second lower conveyor 124*b*. It will be seen that a single, heater may be placed beneath both of the lower conveyors, but the provision of separate heating systems for each laterally disposed conveyor set facilitates the manufacture of the system of FIGS. 4 and 5. The heaters 132*a* and 132*b* deliver heated air to their respective lower plenums 134*a* and 134*b*, which are disposed beneath the respective upper runs of the lower conveyors 124*a* and 124*b*, by respective lower ducts 136*a* and 136*b*. The heated air passes through the upper runs of the porous belts of the lower conveyors 124*a*, 124*b* to dry field crops captured in the respective crop drying enclosures 128*a* and 128*b*. Warm, moist air is expelled from the system by respective first and second upper plenums 138*a* and 138*b*, disposed respectively between the upper and lower runs of the two upper conveyors 116*a* and 116*b*, and respective outlet ducts 140*a* and 140*b*. Additional heat may be provided by infrared or other light sources 42 installed in the lower and upper plenums 134*a*, 134*b*, 138*a*, and 138*b*, as in the case of the embodiment of FIGS. 1 through 3.

Operation of the double lateral belt system of FIGS. 4 and 5 is substantially the same as that of the single upper and lower belt system of FIGS. 1 through 3. The chassis, crop inlet, and discharge ramp are not shown for the system of FIGS. 4 and 5 for clarity in the drawings. It should be understood that the double system illustrated in FIGS. 4 and 5 is exemplary, and that additional conveyor pairs and their heaters and plenums may be added to the configuration shown in FIGS. 4 and 5.

It is to be understood that the present invention is not limited to the embodiments described above, but encompasses any and all embodiments within the scope of the following claims.

I claim:

1. A machine for drying field crops, comprising:

a chassis;

at least one generally horizontally disposed lower conveyor disposed in the chassis, the lower conveyor having a belt and a plurality of flights extending across the belt;

at least one generally horizontally disposed upper conveyor disposed in the chassis directly above the lower conveyor, the upper conveyor having a belt and a plurality of flights extending laterally across the belt, each of the upper conveyor flights engaging a corresponding one of the lower conveyor flights to drive the lower conveyor;

wherein the plurality of flights of the upper conveyor being disposed in pairs, and each pair being spaced from each other pair, and the plurality of flights of the lower being individually spaced apart;

whereby each pair of the upper conveyor flights mesh with a corresponding individual lower conveyor flight; and a crop drying enclosure defined between the lower conveyor and the upper conveyor.

2. The machine for drying field crops according to claim 1, wherein the belt of each said conveyor is an endless porous belt having a lower run and an upper run, said enclosure being defined between the upper run of the lower conveyor and the lower run of the upper conveyor, the machine further comprising:

an air heating system disposed beneath the lower conveyor; and a lower plenum disposed between the lower run and the upper run of the lower conveyor, the air heating system communicating with the lower plenum, the lower plenum delivering heated air to the crop drying enclosure through the porous lower conveyor.

3. The machine for drying field crops according to claim 1, wherein the belt of each said conveyor is an endless porous belt having a lower run and an upper run, said enclosure being defined between the upper run of the lower conveyor and the lower run of the upper conveyor, the machine further comprising:

a lower plenum disposed between the lower run and the upper run of the lower conveyor; and at least one light disposed within the lower plenum, the light being directed to the crop drying enclosure through the upper run of the lower conveyor.

4. The machine for drying field crops according to claim 1, further comprising a plurality of wheels supporting the chassis.

5. The machine for drying field crops according to claim 1, wherein:

said at least one lower conveyor comprises a plurality of laterally disposed lower conveyors; and said at least one upper conveyor comprises a plurality of laterally disposed upper conveyors, each of the upper conveyors being disposed directly above a corresponding one of the lower conveyors.

6. The machine for drying field crops according to claim 1, wherein the lower conveyor is longer than the upper conveyor.

7. The machine for drying field crops according to claim 1, further comprising a prime mover selectively driving the upper conveyor, the prime mover being selected from the group consisting of internal combustion engines and electric motors.

8. A machine for drying field crops, comprising:

a chassis;

at least one generally horizontally disposed lower conveyor disposed in the chassis, the lower conveyor having an endless porous belt defining a lower run and an upper run;

at least one generally horizontally disposed upper conveyor disposed in the chassis directly above the lower conveyor, the upper conveyor having an endless porous belt defining a lower run and an upper run;

a plurality of flights extending across the lower conveyor;

a plurality of flights extending laterally across the upper conveyor, each of the upper conveyor flights engaging a corresponding one of the lower conveyor flights;

wherein the upper conveyor drives the lower conveyor;

a crop drying enclosure defined between the upper run of the lower conveyor and the lower run of the upper conveyor;

an air heating system disposed beneath the lower conveyor; and a lower plenum disposed between the lower run and the upper run of the lower conveyor, the air heating system communicating with the lower plenum, the lower plenum delivering heated air to the crop drying enclosure through the porous belt of the lower conveyor.

9. The machine for drying field crops according to claim 8, further comprising at least one light disposed within the lower plenum, the light being directed to the crop drying enclosure through the upper run of the lower conveyor.

10. The machine for drying field crops according to claim 8, further comprising a plurality of wheels supporting the chassis.

11. The machine for drying field crops according to claim 8, wherein:

said at least one lower conveyor comprises a plurality of laterally disposed lower conveyors; and said at least one upper conveyor comprises a plurality of laterally disposed upper conveyors, each of the upper conveyors being disposed directly above a corresponding one of the lower conveyors.

12. The machine for drying field crops according to claim 8, wherein the lower conveyor is longer than the upper conveyor.

13. The machine for drying field crops according to claim 8 further comprising a prime mover selectively driving the upper conveyor, the prime mover being selected from the group consisting of internal combustion engines and electric motors.

14. A machine for drying field crops, comprising:

a chassis;

at least one generally horizontally disposed lower conveyor disposed in the chassis, the lower conveyor having an endless porous belt defining a lower run and an upper run;

at least one generally horizontally disposed upper conveyor disposed in the chassis directly above the lower conveyor, the upper conveyor having an endless porous belt defining a lower run and an upper run;

a crop drying enclosure defined between the upper run of the lower conveyor and the lower run of the upper conveyor;

a plurality of flights extending across the lower conveyor;

a plurality of flights extending laterally across the upper conveyor, each of the upper conveyor flights engaging a corresponding one of the lower conveyor flights;

wherein the upper conveyor drives the lower conveyor;

a lower plenum disposed between the lower run and the upper run of the lower conveyor; and at least one light disposed within the lower plenum, the light being directed to the crop drying enclosure through the upper run of the lower conveyor.

15. The machine for drying field crops according to claim 14, further comprising an air heating system disposed beneath the lower conveyor, the air heating system communicating with the lower plenum, the lower plenum delivering heated air to the crop drying enclosure through the porous belt of the lower conveyor.

16. The machine for drying field crops according to claim 14, wherein:

said at least one lower conveyor comprises a plurality of laterally disposed lower conveyors; and said at least one upper conveyor comprises a plurality of laterally disposed upper conveyors, each of the upper conveyors being disposed directly above a corresponding one of the lower conveyors.

17. The machine for drying field crops according to claim 14, wherein the lower conveyor is longer than the upper conveyor.

18. The machine for drying field crops according to claim 14 further comprising:

a plurality of wheels supporting the chassis; and a prime mover selectively driving the upper conveyor, the prime mover being selected from the group consisting of internal combustion engines and electric motors.

* * * * *